US007306052B2

(12) United States Patent
Vahabi-Nejad et al.

(10) Patent No.: US 7,306,052 B2
(45) Date of Patent: Dec. 11, 2007

(54) MULTI-POSITION UTILITY HOOK ASSEMBLY FOR TOOL

(75) Inventors: Mariam Vahabi-Nejad, Chicago, IL (US); Walter J. Taylor, McHenry, IL (US); Maureen L. Shea, Wilmette, IL (US); Barry C. Walthall, Wheeling, IL (US)

(73) Assignee: Illinois Tool Works Inc., Glenview, IL (US)

( * ) Notice: Subject to any disclaimer, the term of this patent is extended or adjusted under 35 U.S.C. 154(b) by 238 days.

(21) Appl. No.: 10/958,786

(22) Filed: Oct. 5, 2004

(65) Prior Publication Data

US 2006/0070761 A1 Apr. 6, 2006

(51) Int. Cl.
*E21B 19/04* (2006.01)
*E21B 19/14* (2006.01)

(52) U.S. Cl. ..... 173/217; 173/216; 224/268

(58) Field of Classification Search ..... 173/217; 24/294; 30/296, 298.4, 391; 224/268, 269
See application file for complete search history.

(56) References Cited

U.S. PATENT DOCUMENTS

| | | | | |
|---|---|---|---|---|
| 2,803,048 | A * | 8/1957 | Fernberg | 24/294 |
| 3,797,229 | A * | 3/1974 | Rueff et al. | 59/93 |
| 4,372,468 | A * | 2/1983 | Harvey | 224/268 |
| 4,406,064 | A | 9/1983 | Goss | |
| 4,457,462 | A | 7/1984 | Taormina | |
| 4,787,145 | A | 11/1988 | Klicker et al. | |
| 5,743,451 | A * | 4/1998 | Kahn | 224/268 |
| 5,930,903 | A * | 8/1999 | Hurn et al. | 30/391 |
| 6,199,736 | B1 * | 3/2001 | Musarella et al. | 224/667 |
| 6,230,367 | B1 | 5/2001 | Riedl | |
| 6,325,577 | B1 * | 12/2001 | Anderson | 408/241 R |
| 6,454,147 | B1 * | 9/2002 | Marks | 224/268 |
| 6,679,406 | B2 * | 1/2004 | Sakai et al. | 224/269 |
| 6,722,549 | B2 | 4/2004 | Shkolnikov et al. | |
| 2002/0179659 | A1 | 12/2002 | Shaw | |
| 2004/0050888 | A1 | 3/2004 | Warner | |
| 2004/0178240 | A1 | 9/2004 | Bauer | |

FOREIGN PATENT DOCUMENTS

JP 2001 162566 7/2001

OTHER PUBLICATIONS

DeWalt Brochure, Form # LDWC98.

* cited by examiner

*Primary Examiner*—Rinaldi I. Rada
*Assistant Examiner*—Nathaniel Chukwurah
(74) *Attorney, Agent, or Firm*—Greer, Burns & Crain, Ltd.; Lisa M. Soltis; Mark W. Croll

(57) ABSTRACT

A multi-position hook assembly includes a hook and a holding block. The hook includes a free leg and a mounting leg joined by a top span. In addition, the holding block is configured for rotatably receiving the mounting leg of the hook and for releasably locking the hook in a plurality of positions.

18 Claims, 5 Drawing Sheets

MULTI-POSITION UTILITY HOOK ASSEMBLY FOR TOOL

BACKGROUND

This invention relates to power tools, such as power fastener drivers, saws, drills, and other hand-held power tools typically used on construction sites, in factories, shops or other locations. More specifically, the present invention relates to a hook assembly for such tools.

In the construction industry, tradesmen frequently use power tools in a variety of locations. Often, it is necessary to have the tool operator's hands free for another task in places where there is no convenient surface on which to place the tool. Carpenters, for example, while using a power nailer or powered fastener-driving tool to frame a building, may need to correctly position the next stud before nailing it into place. While working on roof joists, rafters or on ladders, the ability to secure the tool in a convenient location, such as a rafter or a user's belt, facilitates the performance of those tasks. Tradesmen will also save time and money by keeping their tools close by and within reach.

Hook assemblies for power tools have been disclosed in the prior art, such as U.S. Pat. No. 4,406,064 to Goss. This reference teaches a hook that is secured to the tool handle and housing through the holes that mount the handle to the housing. To stabilize the tool, the hanger extends along and covers a portion of the handle. In some tools, it is disadvantageous to cover a portion of the handle with the hanger. Also, power tools vary considerably in their shape, the position of the handle and the distribution of the tool's weight.

Mounting of a hook on the top of a tool near the handle also may result in decreased visibility for the user. Many tools are designed to have the user look over the tool to the workpiece in order to direct its movement. In most cases, this requires looking past or near the handle of the tool. When deployed in a position to hold the tool, conventional hooks often obscure the user's field of vision. Although the prior art devices are adjustable to a position close to the body of the tool, it is inconvenient to keep moving the hook from one position to another each time the tool is used, then set aside.

Another design factor of such tools, especially fastener-driving tools, is that, during use, a battery may become loose or in some cases can even fall out of the battery housing due to the operational vibrations of the tool. If the battery becomes loose, the operation of the tool is disrupted due to poor electrical contacts. Such operational inefficiency may deter operators from using such tools.

Further, known hook assemblies for such power tools typically have only two positions, one when the hook is in use, and a second for stowing the hook out of the way while the tool is operated. In some circumstances, neither of these is a good option. In situations when the operator desires to place the tool on his belt, the position of the hook is not suitable for belt support.

There is a need for an improved hook assembly for a power tool that addresses the above-listed issues of conventional tools.

BRIEF SUMMARY OF THE INVENTION

The above-listed needs are met or exceeded by the present improved multi-position hook assembly for a tool that mounts directly to the tool housing. The present hook assembly allows the user to hang the power tool in a variety locations, including on fixed structures such as ladders or rafters, as well as on a user's belt. In addition, the present hook assembly can be placed in a position that secures the battery in place during tool use.

More specifically, the present multi-position hook assembly for use in a tool includes a hook having a free leg and a mounting leg joined by a top span. In addition, a holding block is configured for rotatably receiving the mounting leg of the hook and for releasably locking the hook in a plurality of positions.

When the present hook is in a first position, it permits the power tool to be hung on framing members, rafters, trusses, ladders, handrails, bracings or plywood sheets. When the hook is rotated and releasably locked into a second position, the power tool can be hung from the user's belt. Furthermore, users will be able to releasably lock the hook into a third position, in which the hook secures the battery in the housing. This latter feature is advantageous because, as those skilled in the art will appreciate, batteries for such tools often become loose and may fall out of the housing due to the vibrations when the power tool is in use.

DETAILED DESCRIPTION

Figure 1:
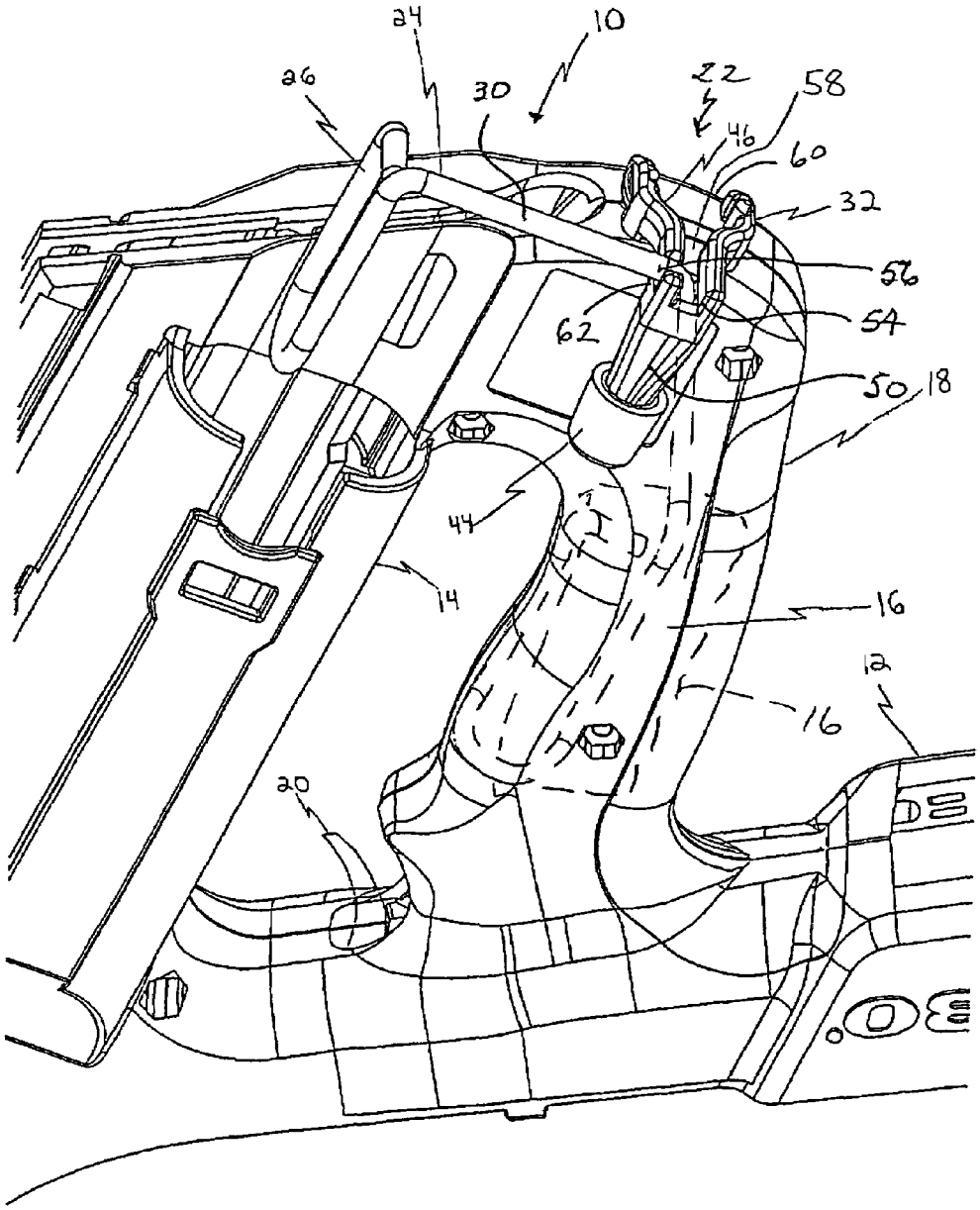
FIG. 1 is a fragmentary rear perspective of a tool equipped with the present multi-position hook assembly.

Referring now to FIG. 1, a combustion-powered, fastener-driving tool suitable for incorporating the present multi-position hook assembly is generally designated 10. The tool 10 includes a main housing 12, usually injection molded plastic, however other materials are contemplated. The main housing 12 typically includes two halves that are secured together along a common seam as is known in the art. In the present tool 10, the main housing 12 includes a battery housing 14 which encloses a battery (not shown). An electronic control unit 16 (shown hidden) of the tool 10 is located inside a handle housing 18. When a trigger 20 is pulled, closing a trigger switch (not shown), the electronic control unit 16 uses energy stored in the battery to power several functions for firing a fastener including, but not limited to fuel delivery, fan operation, and ignition. While the tool 10 is depicted as being of one type of a fastener-driving tool, other types of fastener-driving tools, as well as other portable power tools, including but not limited to saws and drills, are contemplated as having the potential of incorporation of the present multi-position hook assembly.

Figure 4:
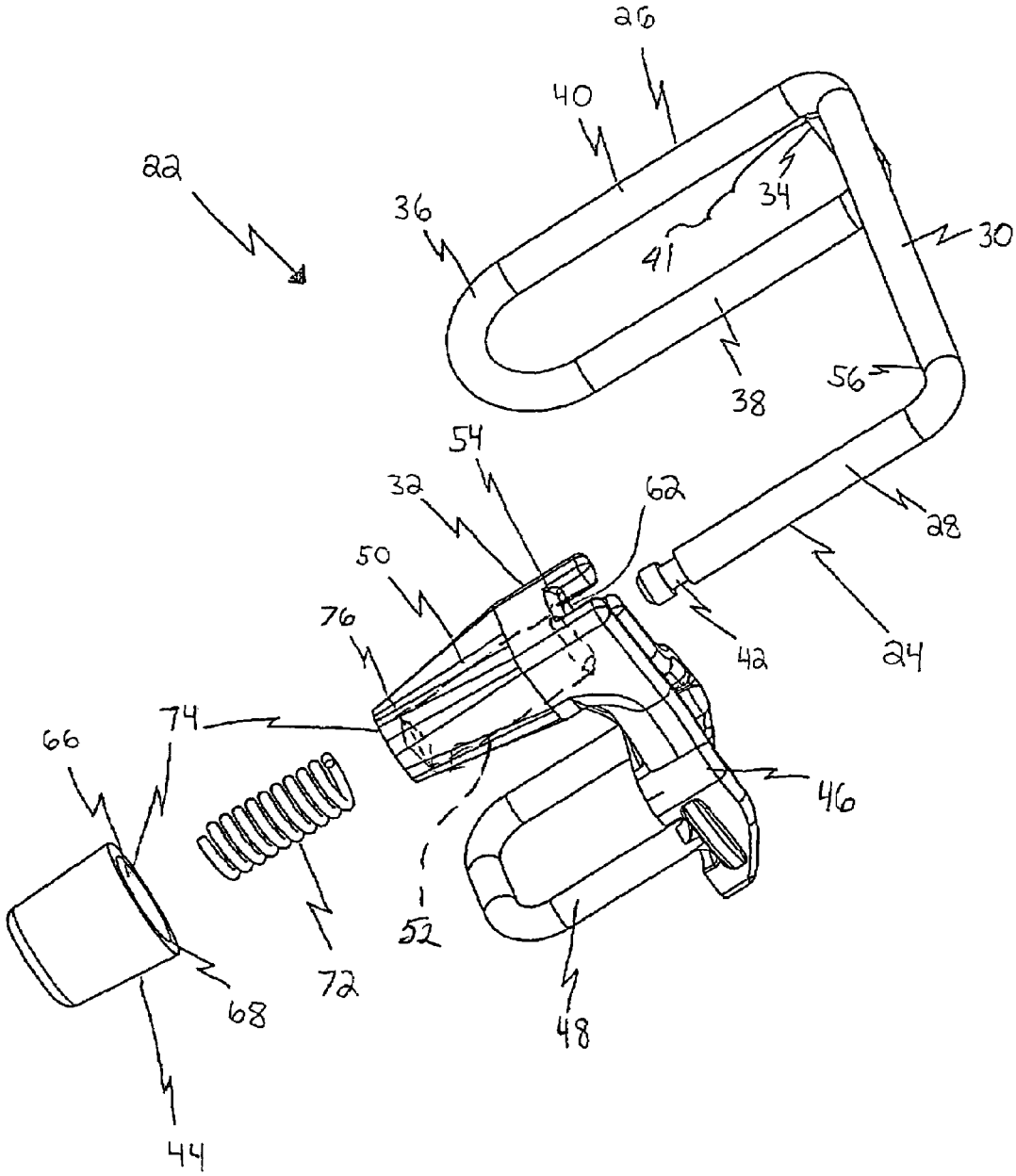
FIG. 4 is an exploded perspective view of the present multi-position hook assembly.

Referring now to FIGS. 1 and 4, a multi-position hook assembly is generally designated 22 and is intended for use in the tool 10. The hook assembly 22 includes a hook 24 having a free leg 26 and a mounting leg 28 joined and spaced apart by a top span 30. In addition, the hook assembly 22 includes a holding block 32 that is configured for rotatably receiving the mounting leg 28 of the hook 24 and for releasably locking the hook 24 in more than one position.

The hook 24 is generally "U"-shaped and preferably constructed from a single length of formed wire. However, other materials and fabrication techniques are contemplated. As seen in FIG. 4, the free leg 26 and the mounting leg 28 are generally parallel with respect to each other. Referring to FIG. 4, the free leg 26 includes a top member 34, a bottom member 36, and two side members 38 and 40, all of which are generally coplanar with respect to each other. Furthermore, the top member 34, the bottom member 36, and the two side members 38 and 40, are generally positioned to form a generally closed rectanguloid shape. It can also be seen that the top member 34 is only attached to one side member 38 and a free end 41 abuts the side member 40 (see FIG. 2). The configuration of the free leg 26 is designed to allow users to slip the free leg of the hook 24 onto their belt.

Referring again to FIG. 4, the mounting leg 28 of the hook 24 also has a mounting formation 42 configured for engaging a stop button 44. An annular groove is shown FIG. 4 as the preferred type of the mounting formation 42 and engages the stop button in a snap fit (see FIG. 5). However, the present invention is not limited to only this type of securing structure.

Now referring to FIGS. 1 and 4, the holding block 32 is configured for rotatably receiving the mounting leg 28 of the hook 24 and for releasably locking the hook 24 in a selected position. More specifically, the holding block 32 has a supporting span 46 that is castellated for supporting the hook 24 in more than one position. Additionally, the holding block 32 further includes an attaching arm 48 and a nose end 50 that are connected to the supporting span 46 so that the nose end 50 and the attaching arm 48 are in generally spaced, parallel relationship to each other. A nose end throughbore 52 (shown hidden) passes through the supporting span 46 and the nose end 50 of the holding block 32 and allows insertion of the mounting leg 28 for slidable and rotatable engagement.

Figure 3:
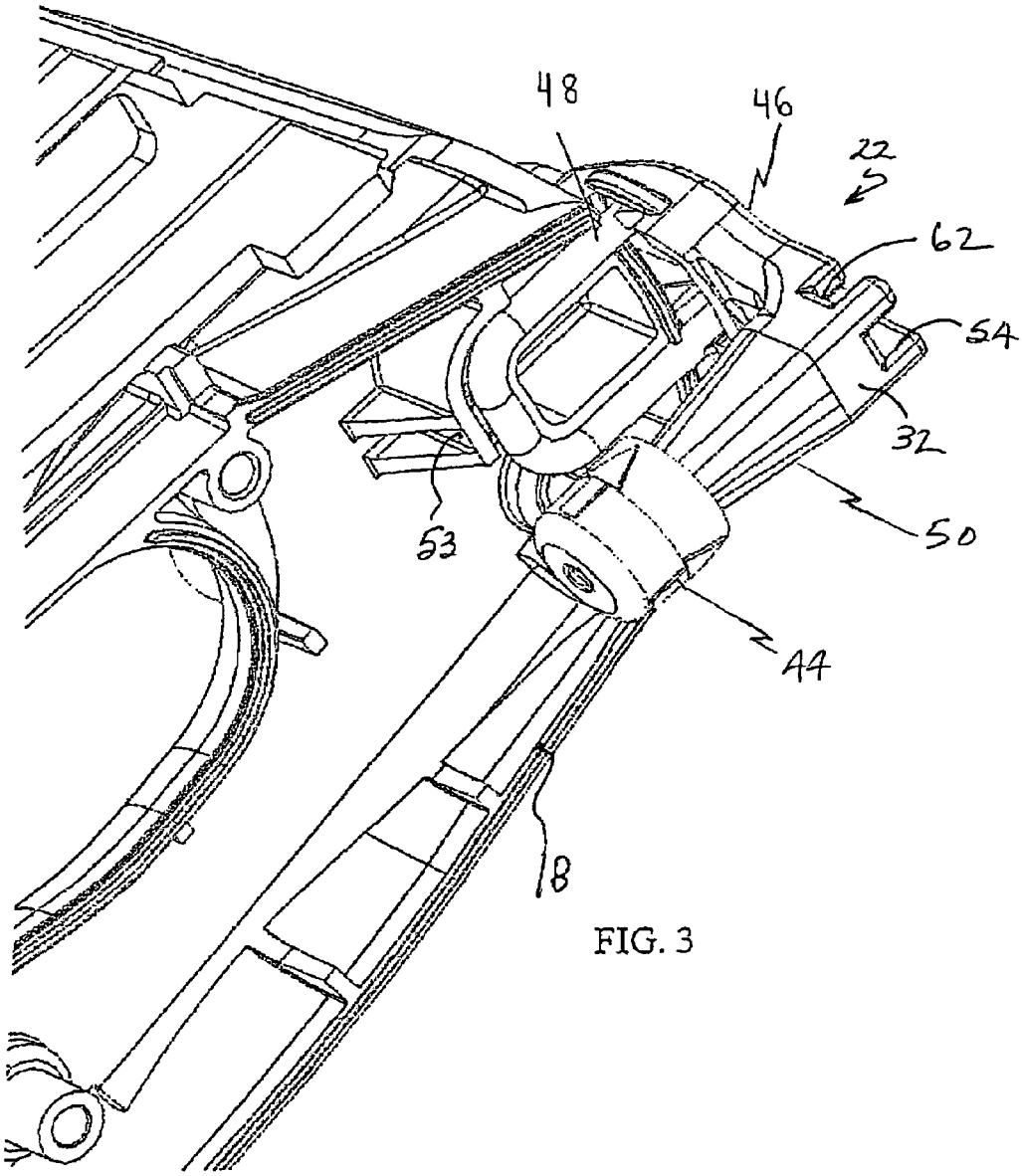
FIG. 3 is a fragmentary perspective of the tool of FIG. 2 equipped with the present multi-position hook assembly shown with other portions omitted for clarity.

As shown in FIG. 3, the attaching arm 48 secures the hook assembly 22 to the tool 10. This is accomplished by inserting the attaching arm 48 between the two halves of the handle housing 18 of the tool 10. Specialized receiving formations 53 in each housing half receive, capture, and support the attaching arm 48 upon assembly of the housing 18.

In the preferred embodiment, the hook 24 can be rotated and releasably locked into three different positions. Referring to FIGS. 1 and 4, when the hook 24 is releasably locked in the first position (shown in phantom) only the supporting span 46 of the holding block 32 supports the hook 24. Specifically, a notch 54 of the supporting span 46 only supports an end 56 of the top span 30 of the hook 24 when the hook is in the first position. In addition, the first position is designed so that the hook 24 projects normally from the housing 12 and the top span 30 has sufficient length for attachment to framing members, rafters, trusses, ladders, handrails, bracings, plywood sheets or other similar structures.

Figure 2:
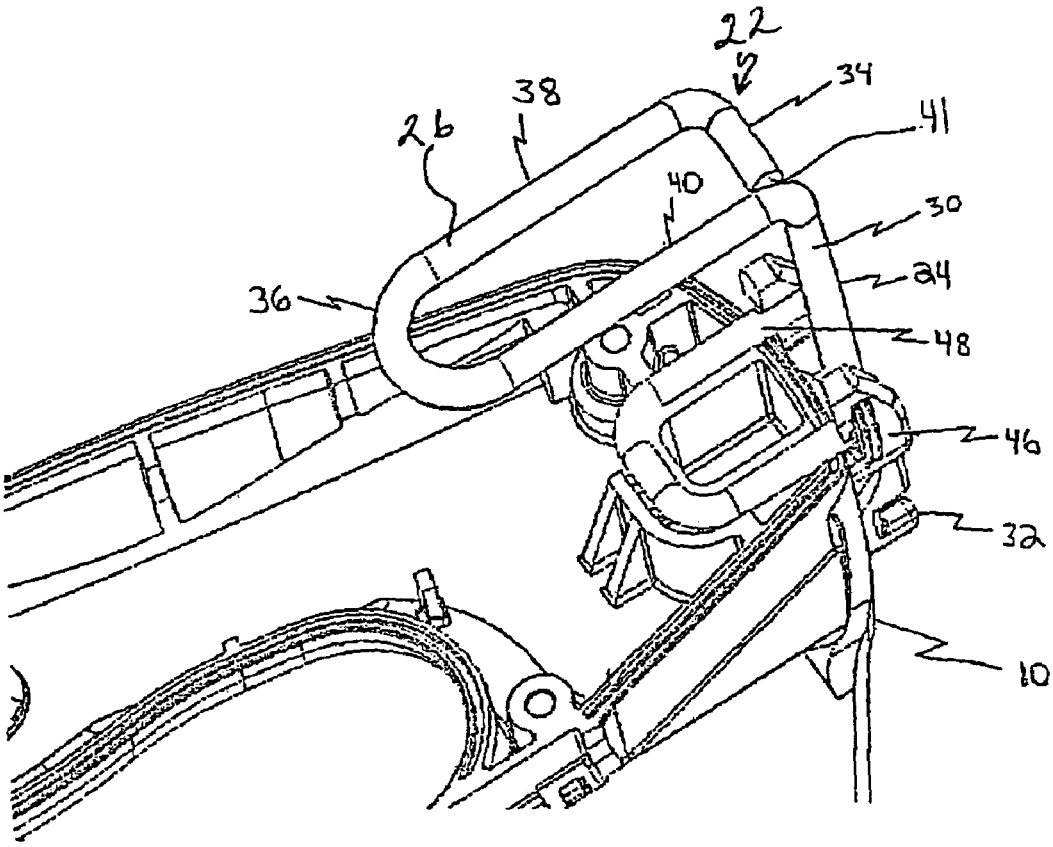
FIG. 2 is a fragmentary perspective of a tool equipped with the multi-position hook assembly with portions omitted for clarity.

Now referring to FIG. 2, when the hook 24 is releasably locked in a second position, the supporting span 46 of the holding block 32 and the tool 10 support the hook 24. More specifically, the castellated supporting span 46 defines a longitudinal track 58. The top span 30 is accommodated and supported in the track 58 (FIG. 1). In the preferred embodiment, the track 58 extends from the notch 54 to a second end 60 of the holding block 32. When seen from above, the track widens as it approaches the end 60, however other lengths and configurations are contemplated provided the hook 24 is adequately supported. The second position is designed so that the free leg 26 of the hook 24 can be attached to a user's belt. One advantage of attaching the hook 24 and the tool 10 to a user's belt, is that both of the user's hands can be used for climbing up and down a ladder, for example, or any other task. In addition, the first position and the second position of the hook 24 are positioned approximately 180° from each other on the holding block 32, however other angular orientations are contemplated depending on the application.

Referring again to FIG. 1, the tool 10 is preferably a power tool of the type having a battery, and when the hook 24 releasably locks into a third position (depicted in solid lines), the hook 24 is in an operational relationship to the battery. More specifically, when the hook 24 is in the third position, the free leg 26 of the hook 24 holds the battery in the battery housing 14. A second notch 62 is provided in the supporting span 46 in close proximity to the notch 54. As such, the notch 62 also supports the end 56 of the top span 30. Those skilled in the art will appreciate an advantage of the third position, which prevents the battery from falling out of the tool when the tool is in a standby mode. In this application, "standby mode" means that the tool is not actively in use. In standby mode, users often deliberately disengage the battery to preserve battery life. Further, the third position is approximately 90° from either the first position or the second position on the holding block 32.

Figure 5:
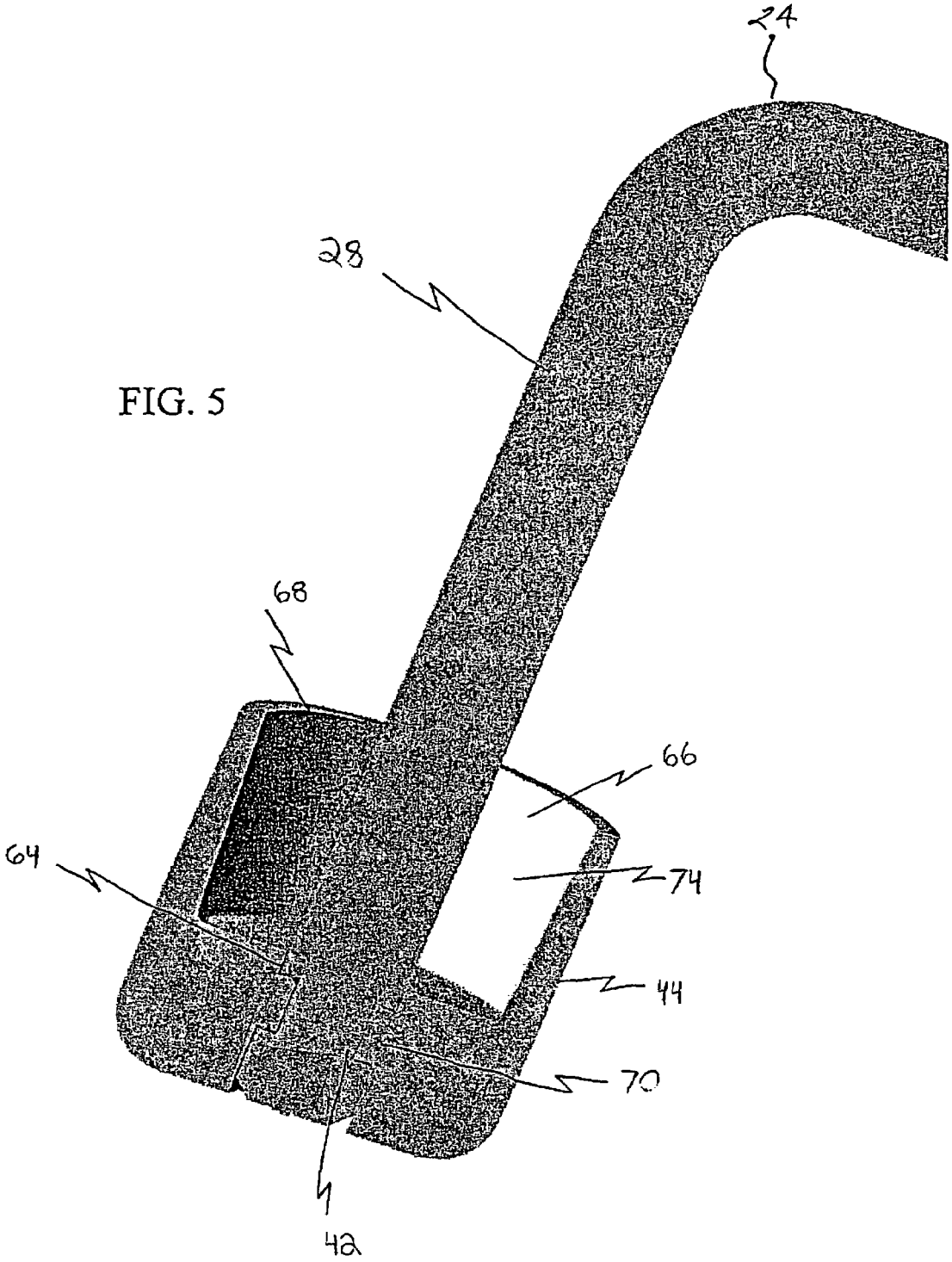
FIG. 5 is a fragmentary vertical section of the present multi-position hook engaged with the stop button.

Now referring to FIGS. 4 and 5, the stop button 44 is configured for receiving the mounting leg 28 of the hook 24. The button 44 has a stop button throughbore 64 and a cavity 66 with an opening 68 at one end. The cavity 66 has a cavity mounting formation 70 that is configured for engaging the mounting leg mounting formation 42. More specifically, FIG. 5 shows the mounting formation 70 as an annular, inwardly projecting rib engaging an annular groove 42. However, it will be understood that the present hook assembly 22 is not limited to this mounting formation.

The hook assembly 22 further includes a biasing element 72 for releasably biasing the hook 24 in one or more positions. Furthermore, the hook assembly 22 also includes a biasing element chamber 74 defined by a counterbore 76 (shown hidden) in the nose end 50 of the holding block 32, and the cavity 66 of the stop button 44 for retaining the biasing element 72. In the preferred embodiment, the biasing element 72 is a compression spring, but any suitable biasing element can be used in the present invention. Upon assembly of the present hook assembly 22, the biasing element 72 is substantially enclosed when it is inside of the biasing element chamber 74. One portion of the biasing element 72 is enclosed in the nose end counterbore 76, and another, opposite portion of the biasing element is enclosed in the cavity 66 of the stop button 44. Finally, when the stop button 44 is depressed, the force of the biasing element 72 is overcome, and the hook 24 is rotatable and releasably lockable into one or more selected positions as described above.

While a particular embodiment of the present multi-position hook assembly for a power tool has been described herein, it will be appreciated by those skilled in the art that changes and modifications may be made thereto without departing from the invention in its broader aspects and as set forth in the following claims.

The invention claimed is:

1. A multi-position hook assembly for use in a tool, comprising:

a hook having a free leg and a mounting leg joined by a top span;

a holding block being configured for rotatably receiving said mounting leg of said hook and for releasably locking said hook in a plurality of positions, said holding block comprising:

a nose end having a throughbore passing longitudinally through said nose end, said nose end configured for rotatably receiving said mounting leg; and a supporting span extending generally transversely from said nose end, said supporting span configured for supportably engaging said hook.

2. The hook assembly of claim 1, wherein said hook is generally "U"-shaped.

3. The hook assembly of claim 1, wherein said free leg comprises:

a top member, a bottom member, and two side members which are generally coplanar with respect to each other and wherein said top member, said bottom member and said two side members are generally positioned to form a rectanguloid shape.

4. The hook assembly of claim 3, wherein said top member is attached to only one of said side members.

5. The hook assembly of claim 1, further comprising a stop button configured for receiving said mounting leg of said hook, having a cavity with an opening at one end of said button and being configured for engaging said mounting leg.

6. The hook assembly of claim 5, wherein said mounting leg has a mounting formation configured for engaging said button.

7. The hook assembly of claim 6, wherein said button has an annular rib inside of said cavity and said mounting formation on said mounting leg is an annular groove for engaging said rib.

8. The hook assembly of claim 5, further comprising a biasing element for releasably biasing said hook in a selected one of said plurality of positions.

9. The hook assembly of claim 8, wherein when said stop button is depressed, said hook is configured to be rotatable and to releasably lock into a plurality of positions in said holding block.

10. The hook assembly of claim 8, further comprising a biasing element chamber defined by said holding block and said cavity of said stop button for retaining said biasing element.

11. The hook assembly of claim 1, wherein said holding block has a supporting span which is castellated for supporting said hook in a plurality of positions.

12. The hook assembly of claim 11, wherein said holding block is configured so that when said hook is releasably locked in a first position only said holding block supports said hook, and wherein when said hook is releasably locked in a second position said holding block forms a track for supporting said hook.

13. The hook assembly of claim 12, wherein said holding block is configured for supporting only an end of said top span when said hook is in said first position.

14. The hook assembly of claim 13, wherein said first position and said second position are positioned approximately 180° from each other on said holding block.

15. The hook assembly of claim 12, wherein the tool is a power tool having a battery, and wherein said hook releasably locks into a third position which is in operational relationship to the battery.

16. The hook assembly of claim 15, wherein said third position is approximately 90° from at least one of said first position and said second position.

17. The hook assembly of claim 1, wherein said holding block further comprises an attaching arm configured for engaging the tool to retain said assembly thereto.

18. The hook assembly of claim 17, wherein said nose end and said attaching arm are connected to said supporting span.

* * * * *